US008772210B2

(12) United States Patent
Baum

(10) Patent No.: US 8,772,210 B2
(45) Date of Patent: Jul. 8, 2014

(54) HIGH VISCOSITY INDEX PAO WITH POLYUREA THICKENERS IN GREASE COMPOSITIONS

(75) Inventor: Mark W. Baum, Sewell, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 902 days.

(21) Appl. No.: 12/378,466

(22) Filed: Feb. 13, 2009

(65) Prior Publication Data

US 2009/0247441 A1 Oct. 1, 2009

Related U.S. Application Data

(60) Provisional application No. 61/072,433, filed on Mar. 31, 2008.

(51) Int. Cl.

| | |
|---|---|
| ***C10M 143/00*** | (2006.01) |
| *C10M 107/02* | (2006.01) |
| *C10M 119/02* | (2006.01) |
| *C10M 119/24* | (2006.01) |
| *C10N 50/10* | (2006.01) |

(52) U.S. Cl.

CPC ..... *C10M 143/00* (2013.01); *C10M 107/02* (2013.01); *C10M 119/02* (2013.01); *C10M 119/24* (2013.01); *C10M 2205/003* (2013.01); *C10M 2205/006* (2013.01); *C10M 2205/0206* (2013.01); *C10M 2205/0213* (2013.01); *C10N 2050/10* (2013.01); *C10N 2220/00* (2013.01)

USPC ..... 508/591

(58) Field of Classification Search

CPC ..... C10M 107/102; C10M 119/02; C10M 119/24; C10M 143/00; C10M 2205/003; C10M 2205/006; C10M 2205/0206

USPC ..... 508/591

See application file for complete search history.

(56) References Cited

U.S. PATENT DOCUMENTS

| | | | | |
|---|---|---|---|---|
| 3,576,923 | A | 4/1971 | Randall et al. | |
| 4,234,435 | A | 11/1980 | Meinhardt et al. | |
| 4,594,378 | A | 6/1986 | Tipton et al. | |
| 4,827,064 | A * | 5/1989 | Wu | 585/10 |
| 4,827,073 | A | 5/1989 | Wu | |
| 4,906,799 | A | 3/1990 | Forbus, Jr. et al. | |
| 4,912,272 | A | 3/1990 | Wu | |
| 4,943,383 | A | 7/1990 | Avery et al. | |
| 4,990,709 | A | 2/1991 | Wu | |

(Continued)

FOREIGN PATENT DOCUMENTS

| | | |
|---|---|---|
| WO | WO 2004/053032 A1 | 5/2004 |
| WO | WO 2007/087324 A2 | 8/2007 |

OTHER PUBLICATIONS

National Lubricating Grease Institute (NLGI) Lubricating Grease Guide, 4th Edition, 1987, p. 2.16-2.17.

(Continued)

*Primary Examiner* — Taiwo Oladapo

(74) *Attorney, Agent, or Firm* — Robert A. Migliorini

(57) ABSTRACT

The invention relates to grease compositions containing high viscosity index polyalphaolefins (HVI-PAO) and polyurea thickeners. The use of HVI-PAOs and polyurea thickeners in a bi-modal base stock grease application provides favorable frictional properties and improved overall performance.

18 Claims, 1 Drawing Sheet

(56) References Cited

U.S. PATENT DOCUMENTS

| | | | | |
|---|---|---|---|---|
| 5,057,235 | A | 10/1991 | Farng et al. | |
| 5,104,579 | A | 4/1992 | Benjamin et al. | |
| 5,132,478 | A | 7/1992 | Ho et al. | |
| 5,146,021 | A | 9/1992 | Jackson et al. | |
| 5,187,236 | A | 2/1993 | Coolbaugh et al. | |
| 5,208,403 | A | 5/1993 | Buchanan et al. | |
| 5,243,114 | A | 9/1993 | Johnson et al. | |
| 5,254,274 | A | 10/1993 | Ho et al. | |
| 5,264,642 | A | 11/1993 | Wu | |
| 5,268,427 | A | 12/1993 | Coolbaugh et al. | |
| 5,275,749 | A | 1/1994 | Kugel et al. | |
| 5,276,100 | A | 1/1994 | Coolbaugh et al. | |
| 5,292,820 | A | 3/1994 | Coolbaugh et al. | |
| 5,352,743 | A | 10/1994 | Coolbaugh et al. | |
| 5,359,009 | A | 10/1994 | Coolbaugh et al. | |
| 5,376,722 | A | 12/1994 | Coolbaugh et al. | |
| 5,399,629 | A | 3/1995 | Coolbaugh et al. | |
| 2004/0092408 | A1* | 5/2004 | Willey et al. | 508/165 |
| 2004/0224859 | A1* | 11/2004 | Numazawa et al. | 508/364 |
| 2007/0072777 | A1 | 3/2007 | Okamura et al. | |
| 2007/0197413 | A1* | 8/2007 | Baum | 508/552 |
| 2007/0289897 | A1 | 12/2007 | Carey et al. | |

OTHER PUBLICATIONS

Chapter 2, Polyinternalolefins, "Synthetics, Mineral Oils and Bio-Based Lubricants—Chemistry and Technology", edited by Leslie R. Rudnick, pp. 37-46, published by CRC Press, Taylor & Francis Group, 2006.

"Kirk-Othmaer's Encyclopedia of Chemical Technology", 2nd Edition, vol. 7, pp. 22-37, Interscience Publishers, NY, 1965.

Vold, Marjorie J., et al., "The Nature of Soap-Thickened Lubricating Greases", Institute Petroleum Tech., pp. 155-163, 1952.

G. Corsico, et al., Chapter 2, Poly(internal olefins) , EURON, Milan, Italy, Chemical Industries (Dekker), 1999, "Synthetic Lubricants and High-Performance Functional Fluids", 2nd Edition, pp. 53-62, published by Marcel Dekker Inc.

* cited by examiner

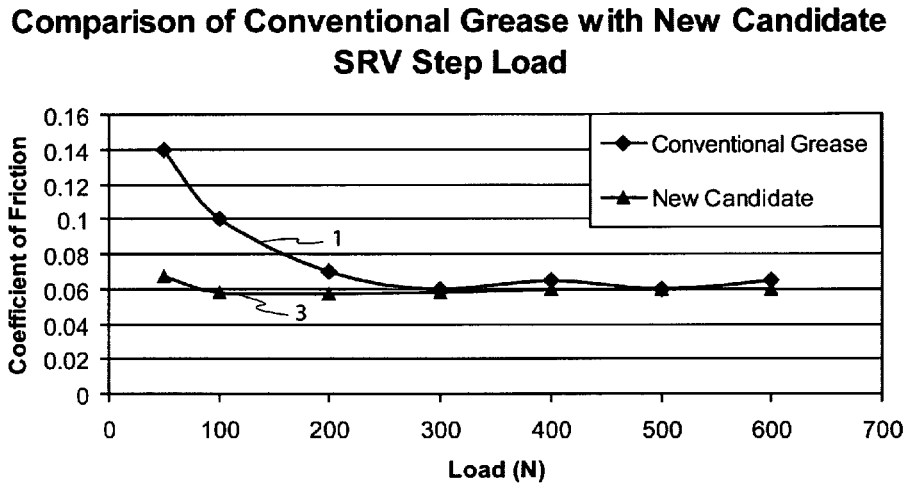
Comparison of Conventional Grease with New Candidate
SRV Step Load
Coefficient of Friction
0.16
0.14
0.12
0.1
0.08
0.06
0.04
0.02
0
0
100
200
300
400
500
600
700
Load (N)
Conventional Grease
New Candidate
1
3

HIGH VISCOSITY INDEX PAO WITH POLYUREA THICKENERS IN GREASE COMPOSITIONS

Non Provisional Application based on U.S. Ser. No. 61/072,433 filed Mar. 31, 2008.

FIELD OF THE INVENTION

The invention relates to grease compositions containing high viscosity index polyalphaolefins ("HVI-PAO") and polyurea thickeners.

BACKGROUND OF THE INVENTION

Lubricating greases are homogeneous products of semi-liquid to solid consistency. Essentially, they consist of a dispersion of a thickener in a liquid lubricant or base oil. In general, the thickener is a significant determinant of the properties of the greases.

ASTM D 288 defines lubricating greases as, "a solid to semifluid product of dispersion of a thickening agent in a liquid lubricant. Other ingredients imparting special properties may be included." See ASTM "Standards on Petroleum Products," p. 156, 1950

A grease is a lubricant which has been thickened in order that it remain in contact with the moving surfaces and not leak out under gravity or centrifugal action, or be squeezed out under pressure. Thus a major practical problem is the provision or a structure which will stand up to shear and temperature stresses to which it may be subjected during use. See Vold, Marjorie J., and Vold Robert D., J, Inst. Petroleum Tech., 38, 155-163 (1952).

Polyurea compounds are among the thickeners used in making greases. Often the polyurea compounds are prepared directly in the base oil by the reaction of amines with isocyanates.

Polyalphaolefins ("PAOs") of different viscosity grades are known to be useful in synthetic and semi-synthetic industrial oil and grease formulations. See, for instance, Chapters 22 and 23 in Rudnick et al., "Synthetic Lubricants and High-Performance Functional Fluids", 2nd Ed. Marcel Dekker, Inc., N.Y. (1999). Compared to the conventional mineral oil-based products, these PAO-based products have excellent viscometrics, high and low temperature performance and energy efficiency under routine conditions and ordinary replacement schedules.

The viscosity-temperature relationship of lubricating oil in a grease is one of the critical criteria, which must be considered when selecting a lubricant for a particular grease application. Viscosity index (VI) is an empirical, unit less number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication films and better protection of the contacting machine elements. In another aspect, as the oil operating temperature decreases, the viscosity of a high VI oil will not increase as much as the viscosity of a low VI oil. This is advantageous because the excessively high viscosity of the low VI oil will decrease the efficiency of the operating machine. Thus a high VI oil has performance advantages in both high and low temperature operation. VI is determined according to ASTM method D-2270-93 [1998]. VI is related to kinematic viscosities measured at 40° C. and 100° C. using ASTM Method D 445-01.

Greases are required to ensure the following: good adhesion, low oil separation, low starting torques, compatibility with synthetic materials, and noise dampening (c.f., Rudnick et al., supra). Most importantly, grease requires good frictional properties. There is a need for a grease meeting all these requirements including improved or lower frictional properties. This invention satisfies that need.

SUMMARY

The invention is directed to oil and grease formulations for industrial use comprising a high viscosity index polyalphaolefin (HVI-PAO) and a polyurea thickener. In one embodiment a grease with favorable frictional properties is disclosed. In this embodiment, the grease comprises a first base stock comprising a PAO with a viscosity over 100 cSt KV 100° C. and a viscosity index over 100, a second base stock with a viscosity at least 25 cSt KV 100° C. less than the viscosity of the first base stock, the second base stock selected from the group consisting of Group II, Group III, PAO, GTL and any combination thereof, a polyurea thickener comprising at least 5 weight of the grease and less than 25 weight percent of the grease.

In a second embodiment a method to improve frictional properties is disclosed. In this embodiment, the method comprises obtaining a grease comprising a first base stock comprising a PAO with a viscosity over 100 cSt KV 100° C. and a viscosity index over 100, a second base stock with a viscosity at least 25 cSt KV 100° C. less than the viscosity of the first base stock, the second base stock selected from the group consisting of Group II, Group III, PAO, GTL and any combination thereof, a polyurea thickener comprising at least 5 weight of the grease and less than 25 weight percent of the grease and lubricating with the grease.

In a third embodiment a method to formulate a grease with improved frictional properties is disclosed. In this embodiment, the method comprises obtaining a first base stock comprising a PAO with a viscosity over 100 cSt KV 100° C. and a viscosity index over 100, a second base stock with a viscosity at least 25 cSt KV 100° C. less than the viscosity of the first base stock, the second base stock selected from the group consisting of Group II, Group III, PAO, GTL and any combination thereof, a polyurea thickener comprising at least 5 weight of the grease and less than 25 weight percent of the grease and lubricating with the grease and blending the first base stock, the second base stock, and thickener to form a grease with favorable frictional properties.

BRIEF DESCRIPTION OF THE DRAWINGS

The present invention and its advantages will be better understood by referring to the following detailed description and the attached drawing.

FIG. 1 is a graph illustrating the viscosity losses for several example formulations.

DETAILED DESCRIPTION

The invention involves a surprising discovery involving novel grease composition comprising a high viscosity index PAO (HVI-PAO) and polyurea thickeners. According to the invention, formulations for use as industrial oils and greases are provided comprising a high viscosity index PAO mixed with a second base stock with a lower viscosity than the high viscosity PAO and a polyurea thickener. The present invention also comprises grease compositions containing lubricant base stocks and additional additives known by persons skilled in the art to be useful for greases.

Applicant has discovered novel combinations of base stocks that provide unexpected favorable improvements in frictional properties pf greases. In U.S. Provisional Application No. 60/811,273, bi-modal combinations of base stocks are disclosed that provide unexpected increases in aeration properties, shear stability and energy efficiency. Applicant has discovered a similar base stock combination provides synergistic frictional property benefits when mixed with a polyurea thickener.

In one embodiment, this novel discovery is based on wide "bi-modal" blends of oil viscosities which are base stock viscosity differences of at least 25 cSt KV 100° C., preferably at least 50 cSt KV 100° C. wherein the high viscosity is at least 100 cSt. Kinematic viscosity ("KV") is determined by ASTM D-445 method by measuring the time for a volume of liquid to flow under gravity through a calibrated glass capillary viscometer. Viscosity is typically measured in centistokes ("cSt", or "$mm^2/s$") units. The ISO viscosity classification which is typically cited for industrial lubes of finished lubricants based on viscosities observed at 40° C. Base stock oils used to blend finished oils, are generally described using viscosities observed at 100° C.

The kinematic viscosity of the grease should preferably be over 100 cSt KV 100° C., more preferably, 150 cSt KV 100° C. and most preferably over 200 cSt KV 100° C. The final viscosity index of the grease should be preferably over 100, more preferably over 150 and most preferably over 200.

Various basic formulations of some embodiments of the invention are disclosed in Table 1. The formulation components in these embodiments are shown in preferred, more preferred and most preferred ranges.

TABLE 1

Basic Formulation Ranges

| Component | Preferred Percentage | Preferred Percentage | Preferred Percentage |
|---|---|---|---|
| Oil Base Stocks | 60-95% | 70-77% | 72-75% |
| Thickener | 5-25% | 17-23% | 18-22% |
| Additive Package | 5-10% | 6-8% | 6-7.5% |

Table 2 discloses the formulation in more detail. The formulation components in these embodiments are shown in preferred, more preferred and most preferred ranges.

TABLE 2

Detailed Formulation and Ranges

| Component | Preferred Range | More Preferred Range | Most Preferred Range |
|---|---|---|---|
| First Base Stock: PAO with greater than 100 cSt KV 100° C. | 40-90% | 80-90% | 82-85% |
| Second Base Stock: a viscosity at least less than 25 cSt KV 100° C. than the first Base Stock | 5-40% | 10-40% | 16-18% |
| Friction Reducer | .5-10.0% | 1.75-5.5% | 3-5.0% |
| Anti wear additive | .2-5.0% | .5-2.5% | 1.0-2.0% |
| Extreme Pressure Additive | .1-4.0% | .25-2.0% | .5-1.5% |
| Rust inhibitor | .1-2.0% | .20-0.5% | 0.20-0.40% |

This "bi-modal" blend of viscosities also provides an improved coefficient of friction. This improved coefficient of friction improves grease performance.

Lubricant Formulation

The formulation is based on bi-modal blends of high viscosity synthetic group IV PAO. In a preferred embodiment, a high viscosity index catalyzed PAO of greater than 100 cSt KV 100° C. is blended with a lower viscosity base stock selected from the group consisting of Group II, Group III, PAO, and GTL with a polyurea thickener.

In one embodiment, the favorable frictional property grease, comprises a first base stock comprising a PAO with a viscosity over 100 cSt KV 100° C. and a viscosity index over 100, a second base stock with a viscosity at least 25 cSt KV 100° C. less than the viscosity of the first base stock, the second base stock selected from the group consisting of Group II, Group III, PAO, GTL and any combination thereof, a polyurea thickener comprising at least 5 weight of the grease and less than 25 weight percent of the grease.

Base Stocks

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table 3 summarizes properties of each of these five groups. All discussion of Gr I to V base stocks can be found in "Synthetics, Mineral Oils and Bio-Based Lubricants, Chemistry and Technology" Edited by L. R. Rudnick, published by CRC Press, Taylor & Francis, 2005.

Group VI in Table 3 are Polyinternal olefins ("PIO"). Polyinternal olefins are long-chain hydrocarbons, typically a linear backbone with some branching randomly attached; they are obtained by oligomerization of internal n-olefins. The catalyst is usually a BF3 complex with a proton source that leads to a cationic polymerization, or promoted BF3 or AlCl3 catalyst system. The process to produce polyinternal olefins (PIO) consists of four steps: reaction, neutralization/washing, hydrogenation and distillation. These steps are somewhat similar to PAO process. PIO are typically available in low viscosity grades, 4 cS, 6 cS and 8 cS. If necessary, low viscosity, 1.5 to 3.9 cS can also be made conveniently by the BF3 process or other cationic processes. Typically, the n-olefins used as starting material are n-C12-C18 internal olefins, more preferably, n-C14-C16 olefins are used. PIO can be made with VI and pour points very similar to PAO, only slightly inferior. They can be used in engine and industrial lubricant formulations. For more detailed discussion, see Chapter 2, Polyinternalolefins in the book, "Synthetics, Mineral Oils, and Bio-Based Lubricants—Chemistry and Technology" Edited by Leslie R. Rudnick, p. 37-46, published by CRC Press, Taylor & Francis Group, 2006; or "Polyinternal Olefins" by Corsico, G.; Mattei, L.; Roselli, A.; Gommellini, Carlo. EURON, Milan, Italy. Chemical Industries (Dekker) (1999), 77(Synthetic Lubricants and High-Performance Functional Fluids, (2nd Edition)), 53-62. Publisher: Marcel Dekker, Inc. PIO was classified by itself as Group VI fluid in API base stock classification.

TABLE 3

| Base Stock Properties | | | |
|---|---|---|---|
| | Saturates | Sulfur | Viscosity Index |
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |
| Group VI | Polyinternal olefins (PIO) | | |

In a preferred embodiment, the base stocks include at least one base stock of synthetic oils and most preferably include at least one base stock of API group IV Poly Alpha Olefins. Synthetic oil for purposes of this application shall include all oils that are not naturally occurring mineral oils. Naturally occurring mineral oils are often referred to as API Group I oils.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant base stocks and, with higher viscosity grades; as VI improvers. They are referred to as High Viscosity Index PAOs or HVI-PAOs. The relatively low molecular weight high viscosity PAO materials were found to be useful as lubricant base stocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived base stocks.

Various modifications and variations of these high viscosity PAO materials are also described in the following U.S. Patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally has a viscosity in the range of about 12 to 5,000 cSt.

Furthermore, the HVI-PAOs generally can be characterized by one or more of the following: C30-C1300 hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 5 to 5000 cSt. In another embodiment, viscosities of the HVI-PAO oligomers measured at 100° C. range from 3 centistokes ("cSt") to 15,000 cSt. Furthermore, the fluids with viscosity at 100° C. of 3 cSt to 5000 cSt have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of C6-C20 1-alkenes. Examples of the feeds can be 1-hexene, 1-octene, 1-decene, 1-dodecene, 1-tetradecene, etc. or mixture of C6 to C14 1-alkenes. C6 and C16 C6 to C20 1-alkenes, C6 and C12 1-alkenes, C6 and C14 1-alkenes, C6 and C16 1-alkenes, C6 and C18 1-alkenes, C8 and C10 1-alkenes, C8 and C12 1-alkenes, C8, C10 and C12 1-alkenes, and other appropriate combinations.

The lube products usually are distilled to remove any low molecular weight compositions such as these boiling below 600° F., or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

It was known that, usually, the oxidative stability and light or UV stability of fluids improves when the amount of unsaturation double bonds or olefinic contents is reduced. Therefore it is necessary to further hydrotreat the polymer if they have high degree of unsaturation. Usually, the fluids with bromine number of less than 5, as measured by ASTM D1159, is suitable for high quality base stock application. Of course, the lower the bromine number, the better the lube quality. Fluids with bromine number of less than 3 or 2 are common. The most preferred range is less than 1 or less than 0.1. The method to hydrotreat to reduce the degree of unsaturation is well known in literature [U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, we can chose to use as is without hydrotreating, or we can choose to hydrotreating to further improve the base stock properties.

Another type of PAO, classified as Group IV base stock and used extensively in many synthetic or partial synthetic industrial lubricants, is produced by oligomerization or polymerization of linear alpha-olefins of C6 to C16 by promoted BF3 or AlCl3 catalysts. This type of PAO is available in many viscosity grades ranging from 1.7 cS to 100 cS from ExxonMobil Chemical Co.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of similar base oils. For purposes of this application synthetic bases stocks shall include Group II, Group III, group IV and Group V base stocks.

Gas to liquid (GTL) base stocks can also be preferentially used with the components of this invention as a portion or all of the base stocks used to formulate the finished lubricant. We have discovered, favorable improvement when the components of this invention are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feed stocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feed stocks. GTL base stock (s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 mm2/s at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

Thickeners

The viscosity grade of the final product is adjusted by suitable blending of base stock components of differing viscosities. In many conventional industrial lubricant formulations, thickeners are used to increase viscosity. HVI-PAO fluids of different viscosity grades are most suitably used to achieve wide finished viscosity grades with significant performance advantages. Usually, differing amounts of the various base stock components (primary hydrocarbon base stocks, secondary base stock and any additional base stock components) of different viscosities, may be suitably blended together to obtain a base stock blend with a viscosity appropriate for blending with the other components (such as described below) of the finished lubricant. This may be determined by one of ordinary skill in the art in possession of the present disclosure without undue experimentation. The viscosity grades for the final product are preferably in the range of ISO 2 to ISO 1000 or even higher for industrial gear lubricant applications, for example, up to about ISO 46,000. For the lower viscosity grades, typically from ISO 2 to ISO 100, the viscosity of the combined base stocks will be slightly higher than that of the finished product, typically from ISO 2 to about ISO 220 but in the more viscous grades up to ISO 46,000, the additives will frequently decrease the viscosity of the base stock blend to a slightly lower value. With a ISO 680 grade lubricant, for example, the base stock blend might be about 780-800 cSt (at 40° C.) depending on the nature and content of the additives.

In conventional formulations, the viscosity of the final product may be brought to the desired grade by the use of polymeric thickeners especially in the product with the more viscous grades, e.g. from ISO 680 to ISO 46,000. Typical thickeners which may be used include the polyisobutylenes, as well as ethylene-propylene polymers, polymethacrylates and various diene block polymers and copolymers, polyolefins and polyalkylstyrenes. These thickeners are commonly used as viscosity index improvers (VIIs) or viscosity index modifiers (VIMs) so that members of this class conventionally confer a useful effect on the temperature-viscosity relationship. Although optionally used in formulations according to the present invention, such components may be blended according commercial market requirement, equipment builder specifications to produce products of the final desired viscosity grade. Typical commercially available viscosity index improvers are polyisobutylenes, polymerized and copolymerized alkyl methacrylates, and mixed esters of styrene maleic anhydride interpolymers reacted with nitrogen containing compounds.

The polyisobutenes, normally with a number average or weight average molecular weight from 10,000 to 15,000, are a commercially important class of VI improvers and generally confer strong viscosity increases as a result of their molecular structure. The diene polymers which are normally copolymers of 1,3-dienes such as butadiene or isoprene, either alone or copolymerized with styrene are also an important class commercially, with typical members of this class sold under names such as Shelivis™. The statistical polymers are usually produced from butadiene and styrene while the block copolymers are normally derived from butadiene/isoprene and isoprene/styrene combinations. These polymers are normally subjected to hydrogenation to remove residual diene unsaturation and to improve stability. The polymethacrylates, normally with number average or weight average molecular weights from 15,000 to 25,000, represent another commercially important class of thickeners and are widely commercially available under designations such as Acryloid™.

One class of polymeric thickeners is the block copolymers produced by the anionic polymerization of unsaturated monomers including styrene, butadiene, and isoprene. Copolymers of this type are described, for instance, in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shelivis™ 40, Shelivis™ 50 and Shelivis™ 90 by Infenium Chemical Company, which are linear anionic copolymers. Of these, Shelivis™ 50 is an anionic diblock copolymer and Shelivis™ 200, Shelivis™ 260 and Shelivis™ 300 are star copolymers.

Some thickeners may be classified as dispersant-viscosity index modifiers because of their dual function, as described in U.S. Pat. No. 4,594,378. The dispersant-viscosity index modifiers disclosed in the '378 patent are the nitrogen-containing esters of carboxylic-containing interpolymers and the oil-soluble acrylate-polymerization products of acrylate esters, alone or in combination. Commercially available dispersant-viscosity index modifiers are sold under trade names Acryloid™ 1263 and 1265 by Rohm and Haas, Viscoplex™ 5151 and 5089 by Rohm-GMBHO™ Registered™ and Lubrizol™ 3702 and 3715.

We have discovered a significant improvement when using polyurea greases. Polyurea greases are among the latest high performance greases to be developed. Their introduction more or less coincides with that of the lithium complex greases. Although certain specific types of greases consumers, such as, precision ball-bearing manufactures, have long appreciated the merits of polyurea greases, these greases have not rapidly gained market share.

Polyurea has the general properties of solubility and resulting gel-forming capability necessary to make an excellent grease thickener. However, polyurea is not a metal salt of a fatty acid (or mixture of acids) as is the soap and soap complex thickeners. Polyurea is something very different. It is a low molecular weight organic polymer which is usually formed in situ in base oil.

Polyurea grease thickeners are produced from the reaction of isocyanates and amines to form ureas. Through the use of polyfunctional isocyanates and amines, polymers, more precisely, polyureas can be formed. The simplest polyurea can be formed from the bifunctional isocyanate and two equivalents of a monofunctional amine to yield a compound containing two urea structures. This type of polyurea is referred to by grease manufactures as diurea. Diureas are used as commercial grease thickeners, and are particularly popular in Japan.

Use of a combination of bifunctional isocyanates and amines, with monofunctional amine, in the correct proportions, yields a tetaurea. The tetaurea is what one normally refers by the name "polyurea." It is the most popular grease thickener used in the United States.

The properties of diurea and polyurea greases are dependant upon the structure of the particular isocyanates and amines used. The properties also depend upon factors affecting the average molecular weight and molecular weight distribution, such as relative amounts of thickener ingredients and manufacturing conditions. See NLGI Lubricating Grease Guide, Fourth Edition, National Lubricating Grease Institute, 1987, p 2.16-2.17.

In preferred embodiment, the polyurea thickener comprises a polyurea particle that is at least between 10 microns and less than 700 microns, a density of less than 7.16 lbs/gal, and a specific surface area of more than 20 $m^2/g$. In a more preferred embodiment, the polyurea grease are manufactured according to the method described in U.S. Patent Application No. 60/791,805 filed Jan. 24, 2006 which is incorporated by reference.

Additives:

Applicant discovered that this unique base stock combination can impart even further favorable properties when combined with specific additive systems. The additives include various commercially available grease additive.

The additives may be chosen to modify various properties of the lubricating oils in the grease. For greases, the additives should provide the following properties, antiwear protection, rust protection, friction reduction, low temperature properties, and extreme pressure properties. Persons skilled in the art will recognize various additives that can be chosen to achieve favorable properties including favorable properties for grease applications.

In various embodiments, it will be understood that additives well known as functional fluid additives in the art, can also be incorporated in the grease compositions of the invention, in relatively small amounts, if desired; frequently, less than about 0.001% up to about 10-20% or more. In one embodiment, at least one oil additive is added from the group consisting of antioxidants, stabilizers, antiwear additives, detergents, antifoam additives, viscosity index improvers, copper passivators, metal deactivators, rust inhibitors, corrosion inhibitors, pour point depressants, anti-wear agents, extreme pressure additives and friction modifiers. The additives listed below are non-limiting examples and are not intended to limit the claims.

Antioxidants: include sterically hindered alkyl phenols such as 2,6-di-tert-butylphenol, 2,6-di-tert-butyl-p-cresol and 2,6-di-tert-butyl-4-(2-octyl-3-propanoic)phenol; N,N-di(alkylphenyl)amines; and alkylated phenylene-diamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as .alpha.-naphthylamine, phenyl-.alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthylamine and nonylphenyl-.alpha.-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

Oxidation inhibitors, organic compounds containing nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-alpha-naphthalamine. These are used in turbine, circulation, and hydraulic oils that are intended for extended service; with ratios of amine/phenolic to be from 1:10 to 10:1 of the mixtures preferred.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-.alpha.-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydrox-y-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methylphenyl)-propionylo-xy]ethyl}2,4,8,10-tetraoxaspiro[5,5]undecane (manufactured by the Sumitomo Kagaku Co. under the trade designation "Sumilizer GA80"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid]glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD): include polymethacrylates. Commonly used additives such as alkylaromatic polymers and polymethacrylates are useful for this purpose; typically the treat rates range from 0.001% to 1.0%.

Anti-rust additives include (short-chain) alkenyl succinic acids, partial esters thereof and nitrogen-containing derivatives thereof. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids (C8-C30), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acids.

Examples of Polybasic Carboxylic Acids: The alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749).

Examples of the alkylamines which function as antirust addives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine.

Examples of the aforementioned N-alkylpolyalkyenediamines include:ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-, myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamin-e, palmitylpentylenediamine, stearylpentylenediamine, oleylpentylenediamine, beef tallow-pentylenediamine, hydrogenated beef tallow-pentylenediamine and soy bean pentylenediamine.

Metal deactivating compounds/Corrosion inhibitors: include alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof. Preferably the acid is a C sub 4 to C sub 22 straight chain unsaturated monocarboxylic acid. The preferred concentration of this additive is from 0.001% to 0.35% by weight of the total lubricant composition. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles and nitrobenzotriazoles. Benzotriazole and tolyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl. Cylcoalkyl is for example cyclopentyl, cyclohexyl, cyclooctyl, cyclodecyl, adamantyl or cyclododecyl. Aralkyl is for example benzyl, 2-phenylethyl, benzhydryl or naphthylmethyl.

Aryl is for example phenyl or naphthyl. The heterocyclic group is for example a morpholine, pyrrolidine, piperidine or a perhydroazepine ring. Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl) triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl)aminomethyl)triazole, 1-(or 4)-(di-n-decylaminomethyl)triazole, 1-(or 4)-(di-n-dodecylaminomethyl)triazole, 1-(or 4)-(di-n-octadecylaminomethyl) triazole, 1-(or 4)-(di-n-eicosylaminomethyl)triazole, 1-(or 4)-[di-(prop-2'-enyl) aminomethyl]triazole, 1-(or 4)-[di-(but-2'-enyl) aminomethyl]triazole, 1-(or 4)-[di-(eicos-2'-enyl) aminomethyl]triazole, 1-(or 4)-(di-cyclohexylaminomethyl) triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl) triazole, 1-(or 4)-(1'-piperidinomethyl)triazole, 1-(or 4)-(1'-perhydoroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(dibutylaminopropyl-aminomethyl)triazole, 1-(or -4)-(1-methanomine)-N,N-bis(2-ethylhexyl)-methyl benzotriazole, N,N-bis-(1- or 4-triazolylmethyl)laurylamine, N,N-bis-(1- or 4-triazolylmethyl)oleylamine, N,N-bis-(1- or 4-triazolylmethyl) ethanolamine and N,N,N',N'-tetra(1- or 4-triazolylmethyl) ethylene diamine.

The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-tolutriazole; benzimidazole and benzimidazole derivatives or concentrates and/or mixtures thereof.

Anti-wear agents/Extreme pressure agent/Friction Reducer: aryl phosphates and phosphites, and metal or ash-free carbamates. A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C 18-C 28 primary alcohols having mostly C20 alcohols as determined by GLC (gas-liquid-chromatography)); and Alfol22+ alcohols (C 18-C 28 primary alcohols containing primarily C 22 alcohols). Alfol alcohols are available from Continental Oil Company. Another example of a commercially available alcohol mixture is Adol 60 (about 75% by weight of a straight chain C 22 primary alcohol, about 15% of a C 20 primary alcohol and about 8% of C 18 and C 24 alcohols). The Adol alcohols are marketed by Ashland Chemical.

A variety of mixtures of monohydric fatty alcohols derived from naturally occurring triglycerides and ranging in chain length from C 8 to C 18 are available from Procter & Gamble Company. These mixtures contain various amounts of fatty alcohols containing 12, 14, 16, or 18 carbon atoms. For example, CO-1214 is a fatty alcohol mixture containing 0.5% of C 10 alcohol, 66.0% of C 12 alcohol, 26.0% of C 14 alcohol and 6.5% of C 16 alcohol.

Another group of commercially available mixtures include the "Neodol" products available from Shell Chemical Co. For example, Neodol 23 is a mixture of C 12 and C 13 alcohols; Neodol 25 is a mixture of C 12 to C 15 alcohols; and Neodol 45 is a mixture of C 14 to C 15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C 11-C 14, and the latter is derived from a C 15-C 18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C.sub.8-30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen O L, Armeen T, Armeen H T, Armeen S and Armeen S D, wherein the letter designation relates to the fatty group, such as coco, oleyl, tallow, or stearyl groups.

Other useful amines include primary ether amines, such as those represented by the formula, R"(OR')×NH 2, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C 16), SURFAM P17B (tridecyloxypropylamine). The carbon chain lengths (i.e., C 14, etc.) of the SURFAMS described above and used hereinafter are approximate and include the oxygen ether linkage.

An amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms and R 6 is a hydrocarbyl group containing from 1 to about 12 carbon atoms. Such amines are illustrated by tert-butyl amine, tert-hexyl amine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C 11-C 14 tertiary alkyl primary amines and "Primene JMT" which is a similar mixture of C 18-C 22 tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

Lubricating compositions also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated, heptadeceneyl derived oleyl groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 Such amine phosphates are suitably present in an amount of from 0.01 to 2%, preferably 0.2 to 0.6% by weight of the lubricant composition.

At least one straight and/or branched chain saturated or unsaturated monocarboxylic acid which is optionally sulphurised in an amount which may be up to 35% by weight; and/or an ester of such an acid. At least one triazole or alkyl derivatives thereof, or short chain alkyl of up to 5 carbon atoms and is hydrogen, morphilino, alkyl, amido, amino, hydroxy or alkyl or aryl substituted derivatives thereof; or a triazole selected from 1,2,4 triazole, 1,2,3 triazole, 3-amino-1,2,4 triazole, 1-H-benzotriazole-1-yl-methylisocyanide, methylene-bis-benzotriazole and naphthotriazole; and The neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

The phosphites include, for example, triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite. Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentyl amine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine.

Phosphates or their amine salts are added to the base oil in an amount of from 0.03 to 5% by weight, preferably from 0.1 to 4% by weight, relative to the total weight of the composition. Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: Hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); The substituted hydrocarbon substituents, that is, substituents containing non-hydrocarbon groups which, in the context of this invention, do not alter the predominantly hydrocarbon substituent, hydroxy, alkoxy, nitro); Hetero-atom containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimaly containing sulfur, nitrogen, or oxygen, they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol®" alcohols marketed by Continental Oil Corporation. Alfol® 810, for instance, is a mixture containing alcohols consisting essentially of straight chain, primary alcohols having from 8 to 12 carbon atoms. Alfol® 12 is a mixture of mostly C12 fatty alcohols; Alfol™ 22+ comprises C 18-28 primary alcohols having mostly C 22 alcohols, and so on. Various mixtures of monohydric fatty alcohols derived from naturally occurring triglycerides and ranging in chain length from C 8 to C 18 are available from Procter & Gamble Company. "Neodol™" alcohols are available from Shell Chemical Co., where, for instance, Neodol™ 25 is a mixture of C 12 to C 15 alcohols.

Specific examples of some of the phosphites within the scope of the invention include phosphorous acid, mono-, di-, or tri-propyl phosphite; mono-, di-, or tri-butyl phosphite, di-, or tri-amyl phosphite; mono-, di-, or tri-hexyl phosphite; mono-, di-, or tri-phenyl; mono-, di-, or tri-tolyl phosphite; mono-, di-, or tri-cresyl phosphite; dibutyl phenyl phosphite or mono-, di-, or tri-phosphite, amyl dicresyl phosphite.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-l-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More prferentially, the dimethyl-, diethyl-, and dipropyl-oleyl phohphonates can be used. Neutral acids of phosphorus acids are the triesters rather than an acid (HO—P) or a salt of an acid.

Any C4 to C8 alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

The phosphoric acid ester, thiophosphoric acid ester, and amine salt thereof functions to enhance the lubricating performances, and can be selected from known compounds conventionally employed as extreme pressure agents. Generally employed are phosphoric acid esters, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Also employable are amine salts of the above-mentioned phosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, and an amine salt thereof may be used. The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200 C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

These extreme pressure additives can be used individually or in the form of mixtures, conveniently in an amount within the range from 0.1 to 2 parts by weight, per 100 parts by weight of the base oil. All the above can be performance enhanceded using a variety of cobase stocks, AN, AB, ADPO, ADPS, ADPM, and/or a variety of mono-basic, di-basic, and tribasic esters in conjunction with low sulfur, low aromatic, low iodine number, low bromine number, high analine point, isoparafin.

EXAMPLES

The following examples are meant to illustrate the present invention and provide a comparison with other methods and the products produced therefrom. Numerous modifications and variations are possible and it is to be understood that within the scope of the appended claims, the invention may be practiced otherwise than as specifically described herein.

We formulated an inventive grease blends for comparison against a typical grease. The application was for constant velocity joint grease. Example 1 is typical grease and example 2 is an embodiment of the invention. The relative amounts of base stock, polyurea thickener and additive package are shown in Table 4. Both blends contain two base stocks and contained the same standard thickener and additive package. The additive package includes friction reducers, antiwear additives, extreme pressure additives, and rust inhibitors.

TABLE 4

| | Example | |
|---|---|---|
| | 1 | 2 |
| Base stock | 83% 150 cSt KV 100° C. Paraffinic Bright Stock | 83% 150 cSt KV 100° C. PAO |
| Base stock | 17% 6 cSt KV 100° C. PAO | 17% 100 cSt KV PAO |
| Total weight percent of base stock in grease | 74.1% | 74.1% |
| Grease Viscosity @40° C. | 270.825 | 1460.29 |
| Grease Viscosity @100° C. | 22.410 | 140.233 |
| Viscosity Index | 100.6 | 205.3 |
| Polyurea thickener | 19.1% | 19.1% |
| Additive Package | 6.8% | 6.8% |

The first blend comprises a 150 cSt KV100° C. Paraffinic Bright Stock. The second base stock contained a PAO with a viscosity of 6 cSt, KV100° C. The blend also includes a polyurea thickener and a grease additive package.

The second blend comprises a PAO base stock with a viscosity of 150 cSt, KV 100° C. The second base stock is a PAO base stock with a viscosity of 100 cSt, KV 100° C. The blend also includes polyurea thickener and a grease additive package.

An SRV test was run to demonstrate the coefficient of friction of the two greases. The Optimol SRV Test is a ball on disk (Point Contact) test. The ball oscillates on grease sample, 1 mm stroke, 80° C., 1000 Hz, and load is applied every 3 min and graduates from 50N to 1200N. Coefficient of Friction (μ) is reported. This test is a slightly modified version of ASTM tests D-5706 and D-5707.

The data from the test is shown in table 5 and FIG. 1. FIG. 1 is a graph illustrating the improved coefficient of friction of the new candidate grease 3 compared to a typical grease formulation 1.

There is a correlation between wear constant velocity joint of test elements and performance at low (N) load region of the SRV step load test. Emphasis is on the low load region between 10 to 100 N. A preferred grease would maintain a profile with a coefficient of friction below 0.6μ throughout the test duration.

The flat line of the new candidate grease 3 is a significant improvement over a typical grease formulation 1 and thus the PAO bi-modal base stock formulation with polyurea thickeners provides a favorable coefficient of friction profile.

While this example has been to a constant velocity joint grease, these examples are not intended to be limiting. The novel formulations provide improved properties to all greases.

TABLE 5

| Example Load (N) | Conventional Grease Coefficient of Friction | New Candidate Coefficient of Friction |
|---|---|---|
| 50 | 0.140 | 0.067 |
| 100 | 0.100 | 0.058 |
| 200 | 0.070 | 0.057 |
| 300 | 0.060 | 0.058 |
| 400 | 0.065 | 0.060 |
| 500 | 0.060 | 0.060 |
| 600 | 0.065 | 0.060 |

In addition, based on the disclosure herein other base stocks of a "bi-modal" blend with at least one PAO base stock and a polyurea thickener can also be envisioned with the benefit of the disclosure herein to deliver other favorable properties to grease. These properties include but are not limited to shear stability, improved low temperature properties and any combination thereof.

All patents and patent applications, test procedures (for example, ASTM methods), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The invention has been described above with reference to numerous embodiments and specific examples. Many variations will suggest themselves to those skilled in this art in light of the above detailed description. All such obvious variations are within the full intended scope of the appended claims.

What is claimed is:

1. A grease with favorable frictional properties, comprising a) a first base stock comprising a PAO with a viscosity of about 150 cSt KV 100° C. and a viscosity index over 100;

b) a second base stock with a viscosity of about 50 cSt KV 100° C. less than the viscosity of the first base stock, the second base stock is a PAO, and c) a polyurea thickener, d) an additive package comprising a combination of friction reducers, antiwear additives, extreme pressure additives and rust inhibitors at about 6.8 weight percent of the grease, wherein the first base stock comprises about 83 weight percent of the total base stock, the second base stock comprises about 17 weight percent of the total base stock, the total base stock comprises about 74 weight percent of the grease and the polyurea thickener comprises about 19.1 weight percent of the grease, and wherein the coefficient of friction of the grease as measured by the Optimol SRV test is less than or equal to 0.067 over a load range of from 50 to 600 Newtons.

2. The grease according to claim 1, wherein the grease is used as a constant velocity joint grease.

3. The grease according to claim 1 further comprising at least one additive selected from the group consisting of antiwear additives, rust protection additives, friction reduction additives, low temperature pro y additives, and extreme pressure additives and any combination thereof.

4. The grease according to claim 1 wherein the polyurea is a reaction of isocyanates and amines.

5. The grease according to claim 1 wherein the polyurea thickener comprises a polyurea particle that is at least between 10 microns and less than 700 microns, a density of less than 7.16 lb/gal, and a specific surface area of more than 20 $m^2/g$.

6. The grease according to claim 1 wherein the grease has a viscosity of greater than 100 cSt KV 100° C. and a viscosity index of greater than 100.

7. A method of improving frictional properties, comprising a) obtaining a grease with favorable frictional properties comprising a first base stock comprising a PAO with a viscosity of about 150 cSt KV 100° C. and a viscosity index over 100, a second base stock with a viscosity of about 50 cSt KV 100° C. less than the viscosity of the first base stock, the second base stock is a PAO, an additive package comprising a combination of friction reducers, antiwear additives, extreme pressure additive and rust inhibitors at 6.8 weight percent of the grease, and a polyurea thickener and b) lubricating with the grease, wherein the first base stock comprises about 83 weight percent of the total base stock, the second base stock comprises about 17 weight percent of the total base stock, the total base stock comprises about 74 weight percent of the grease and the polyurea thickener comprises about 19.1 weight percent of the grease, and wherein the coefficient of friction of the grease as measured by the Optimol SRV test is less than or equal to 0.067 over a load range of from 50 to 600 Newtons.

8. The method according to claim 7, wherein the grease is used as a constant velocity joint grease.

9. The method according to claim 7 wherein the grease further comprises at least one additive selected from the group consisting of antiwear additives, rust protection additives, friction reduction additives, low temperature property additives, and extreme pressure additives and any combination thereof.

10. The method according to claim 7 wherein the polyurea thickener is a reaction of isocyanates and amines.

11. The method according to claim 7 wherein the polyurea thickener comprises a polyurea particle that is at least between 10 microns and less than 700 microns, a density of less than 7.16 lbs/gal, and a specific surface area of more than 20 $m^2/g$.

12. The method according to claim 7 wherein the grease has a viscosity of greater than 100 cSt KV 100° C. and a viscosity index of greater than 100.

13. A method of formulating a grease with favorable frictional properties, comprising a) obtaining a first base stock comprising a PAO with a viscosity of about 150 cST KV 100° C. and a viscosity index over 100, a second base stock with a viscosity about 50 cSt KV 100° C. less than the viscosity of the first base stock, the second base stock is a PAO, an additive package comprising a combination of friction reducers, antiwear additives, extreme pressure additives and rust inhibitors at about 6.8 weight percent of the grease, and a polyurea thickener and b) formulating the first base stock, the second base stock, and the thickener to form a grease with favorable frictional properties, wherein the first base stock comprises about 83 weight percent of the total base stock, the second base stock comprises about 17 weight percent of the total base stock, the total base stock comprises about 74 weight percent of the grease and the polyurea thickener comprises about 19.1 weight percent of the grease, and wherein the coefficient of friction of the grease as measured by the Optimol SRV test is less than or equal to 0.067 over a load range of from 50 to 600 Newtons.

14. The method according to claim 13, wherein the grease is used as a constant velocity joint grease.

15. The method according to claim 13 wherein the grease further comprises at least one additive selected from the group consisting of antiwear additives, rust protection additives, friction reduction additives, low temperature property additives, and extreme pressure additives and any combination thereof.

16. The method according to claim 13 wherein the polyurea thickener is a reaction of isocyanates and amines.

17. The method according to claim 13 wherein the polyurea thickener comprises a polyurea particle that is at least between 10 microns and less than 700 microns, a density of less than 7.16 lbs/gal, and a specific surface area of more than 20 $m^2/g$.

18. The method according to claim 13 wherein the grease has a viscosity of greater than 100 cSt KV 100° C. and a viscosity index of greater than 100.

* * * * *